US009562432B2

(12) United States Patent
Heim et al.

(10) Patent No.: US 9,562,432 B2
(45) Date of Patent: Feb. 7, 2017

(54) INFLATABLE AIR BARRIERS

(71) Applicant: RITE-HITE HOLDING CORPORATION, Milwaukee, WI (US)

(72) Inventors: Frank Heim, Platteville, WI (US); Kevin J. Gebke, Dubuque, IA (US); Nicholas L. Kaufmann, Sherill, IA (US); Nicolas B. Paschke, Mequon, WI (US); Terry L. Bauer, Elizabeth, IL (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 260 days.

(21) Appl. No.: 13/623,614

(22) Filed: Sep. 20, 2012

(65) Prior Publication Data

US 2014/0075849 A1 Mar. 20, 2014

(51) Int. Cl.
*E04H 9/14* (2006.01)
*E21F 11/00* (2006.01)
*E21F 1/10* (2006.01)

(52) U.S. Cl.
CPC . *E21F 11/00* (2013.01); *E21F 1/10* (2013.01)

(58) Field of Classification Search
CPC ..... E04H 15/20; E04H 15/22; A62C 2/10
USPC ..... 52/1, 2.11, 2.13, 2.17, 2.18, 2.22, 2.23, 52/2.25; 49/477.1
See application file for complete search history.

(56) References Cited

U.S. PATENT DOCUMENTS 6,467,221 B1 * 10/2002 Bigelow ..... 52/2.17
6,875,119 B2 * 4/2005 Murphy et al. ..... 472/134
7,467,496 B1 * 12/2008 Cuisset et al. ..... 52/2.18
7,578,097 B2 * 8/2009 Dondlinger et al. ..... 49/477.1
7,900,401 B2 * 3/2011 Pedretti ..... 52/2.11
7,963,075 B2 * 6/2011 Howland ..... 52/202
8,079,182 B1 * 12/2011 Higgins ..... 52/2.11
8,171,681 B2 * 5/2012 Miller ..... 52/202
8,685,513 B1 * 4/2014 Dry ..... 428/35.8
2007/0113486 A1 * 5/2007 Howland ..... 52/1
2008/0216416 A1 * 9/2008 Leano ..... 52/2.22
2010/0083585 A1 * 4/2010 Miller ..... 52/2.11
2013/0049436 A1 * 2/2013 Paton-Ash ..... 299/12
2013/0167452 A1 * 7/2013 Jacques et al. ..... 52/2.18
2013/0186007 A1 * 7/2013 Mouyiaris ..... 52/2.11
2013/0199423 A1 * 8/2013 MacCallum ..... E21F 11/00 109/1 S (Continued)

OTHER PUBLICATIONS

MacCallum et al., "Mine Emergency Refuge Systems", U.S. Appl. No. 61/596,678, filed Feb. 8, 2012, 24 pages.

*Primary Examiner* — James Buckle, Jr.

(74) *Attorney, Agent, or Firm* — Hanley, Flight & Zimmerman, LLC

(57) ABSTRACT

Example inflatable air barriers are disclosed herein. Some example barriers disclosed herein include one or more inflatable tubes for maintaining a sealed airlock leading to an underground shelter. Such shelters provide miners with temporary refuge in the event of a mining incident involving the release of contaminated air. Some example barriers disclosed herein include one or more of the following: an inflatable tube with an air permeable section, a resiliently compressible foam body or other resilient member for supporting a deflated tube, a magnet for providing a secure seal, an inflatable tube with interchangeable end caps, elastic bands for securing the position of an inflatable tube, or an inflatable tube with one or more windows.

28 Claims, 11 Drawing Sheets

(56) References Cited

U.S. PATENT DOCUMENTS

| | | | | |
|---|---|---|---|---|
| 2013/0227895 | A1* | 9/2013 | Mouyiaris et al. | 52/2.11 |
| 2013/0298477 | A1* | 11/2013 | Krummenacher | 52/2.11 |

* cited by examiner

INFLATABLE AIR BARRIERS

FIELD OF THE DISCLOSURE

This patent generally pertains to pass-through barriers and, more specifically, pass-through barriers for helping isolate one area from another while preserving the breathable air quality of one of the areas.

BACKGROUND

To protect miners in the event of a mining incident involving the release of toxic gas, smoke or dust, or an incident that reduces the oxygen content of the air; some mines have an underground shelter that provides the miners with a temporary place of refuge isolated from the contaminated air, or air having a low oxygen content. Such shelters often have a sealed door, emergency provisions, and means for providing at least a limited supply of breathable air. The miners can stay in the shelter until they are rescued or until it is safe to leave.

DETAILED DESCRIPTION

Figure 1:
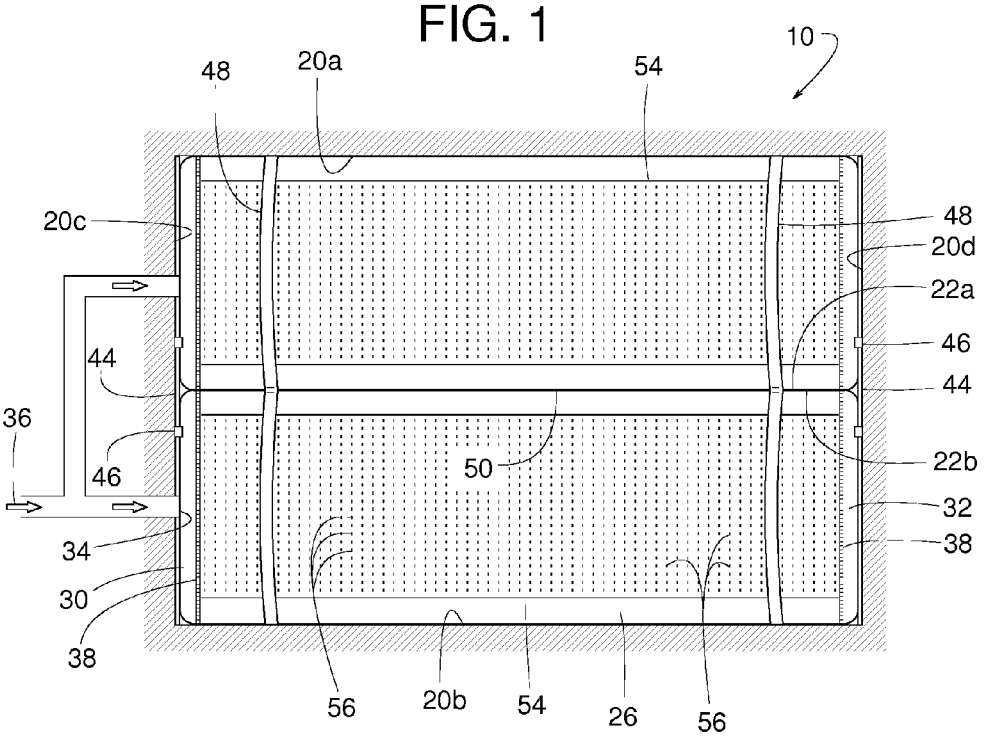
FIG. 1 is a side view of an example inflatable air barrier constructed according to the teachings disclosed herein, wherein the barrier is in a closed, inflated state.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

FIGS. 1-6 show front and side views of an example inflatable air barrier 10 under various conditions. Although barrier 10 can be used in a variety of applications, barrier 10 is particularly suited for providing miners with sealed access to a temporary refuge chamber 12 in case other areas of the mine become contaminated with toxic gas, smoke or dust, for example.

In examples where refuge chamber 12 already has a sealed door 14, inflatable barrier 10 can be used for creating an airlock between barrier 10 and the chamber's door 14. With barrier 10, the airlock inhibits toxins from flowing freely into chamber 12 as miners pass through door 14. Although some contaminants might still enter chamber 12 through door 14 (when open), barrier 10 helps separate a designated more contaminated area 16 of the mine from a designated less contaminated area 18. The less contaminated area 18 thus provides an airlock or buffer that helps isolate chamber 12 from the more contaminated area 16.

In the example illustrated in FIGS. 1-6, barrier 10 is installed within a passageway 20 extending between areas 16 and 18. In this example, passageway 20 is defined by an upper surface 20*a*, a lower surface 20*b*, a first lateral surface 20*c* and a second lateral surface 20*d*. In the illustrated example, barrier 10 comprises at least one inflatable tube 22 (e.g., a first tube 22*a*, a second tube 22*b*, etc.) to provide quick, easy passage; to sealingly conform to the irregular shape of an individual 24 passing through barrier 10; and to avoid relying on mechanisms that might jamb due to corrosion, dust or dirt.

Tube 22, in some examples, comprises a sidewall 26 made of a pliable fabric or sheet of material. Examples of such sidewall materials include, but are not limited to, polyester sheeting and polyester fabric. Some example materials are perforated, porous, impervious to gas, or are combinations thereof (e.g., some porous areas and some areas impervious to gas). Some example materials are impregnated or coated with a sealant such as acrylic or polyurethane. Some example materials are uncoated. Some example materials are fire or heat resistant. Some example sidewalls and/or one or more sidewall portions 28 (FIGS. 10-15) are transparent to provide at least some window so individuals can see the conditions on the opposite side of the barrier.

In the illustrated example, end caps 30 and 32 are attached to opposite ends of tube 22. End cap 32 is closed while end cap 30 has an air inlet 34 for delivering relatively clean pressurized air 36 into tube 22 when needed. In some examples, a releasable fastener 38 (e.g., a zipper) connects end caps 30 and/or 32 to sidewall 26 so that end caps 30 and/or 32 are removable, interchangeable and reattachable for various installations (e.g., supplying pressurized air 36 from the left or right end, as viewed in FIG. 1). In some examples, the pressurized air 36 is fed through a sidewall inlet of tube 22, rather than through end cap 30.

Figure 2:
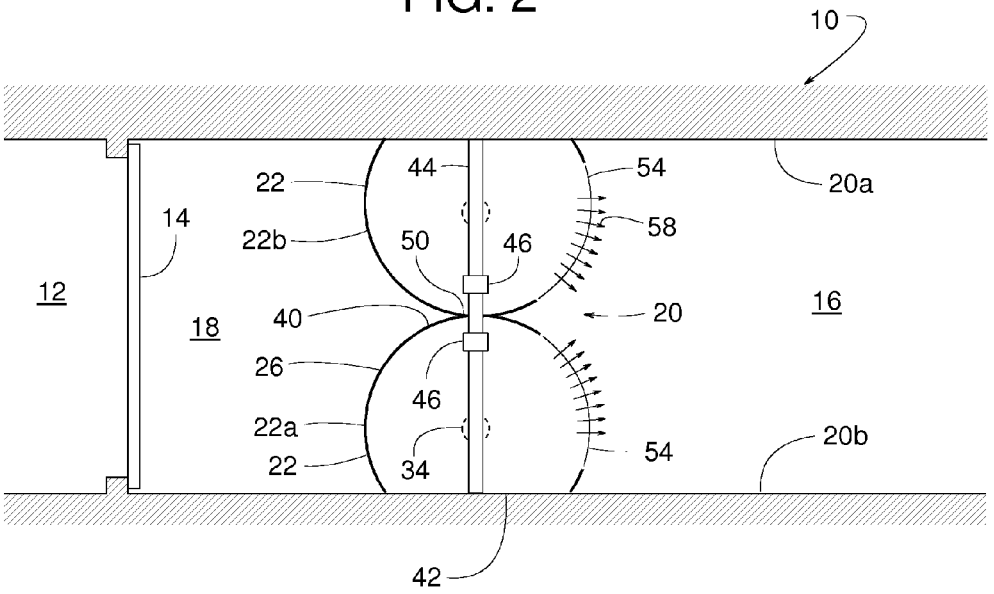
FIG. 2 is an end view of the example air barrier of FIG. 1.

The shape of end caps 30 and 32 and tube 22 may vary. Some example shapes include, but are not limited to, round, half-round, D-shaped, triangular, elliptical, and/or rectangular. A D-shaped tube that is partially round with a flat mounting side has been found to be particularly stable with minimal shifting. In the illustrated examples, tube 22 is a truncated cylindrical shape (cylindrical but with a flat side), wherein the truncated cylindrical tube has an inflated volume that is at least 50% of a fully cylindrical tube of the same diameter. FIG. 2, for example, shows tube 22*a* having a curved surface 40 facing upward and a substantially flat surface 42 facing downward for mounting and sealing to the passageway's lower surface 20*b*.

Although the actual apparatus for mounting barrier 10 within passageway 20 may vary, in some examples, elastic straps 44 fastened to lateral surfaces 20*c* and 20*d* and threaded through loops 46 on end caps 30 and 32 help hold the ends of barrier 10 to lateral surfaces 20*c* and 20*d* and/or to couple the tubes 22 together. In some examples, the straps 44 may be threaded through or otherwise coupled to one or more brackets to couple the tubes 22 together and/or couple one or more of the tubes 22 to the passageway 22. The brackets may be coupled to the passageway 22. Straps 44 being elastic provide some flexibility as barrier 10 distorts under the pressure of individual 24 crawling through barrier 10. An elastic strap is just one example of a resiliently flexible elongate member. An elastic cord is another example of a resiliently flexible elongate member. In some examples, elastic straps 48 sewn or otherwise attached (e.g., through loops) to tubes 22*a* and 22*b* help stabilize the position of tubes 22*a* and 22*b* relative to each other and/or couple the tubes 22 together. In some examples, the ends of straps 48 are further attached to the passageway's upper surface 20*a* and lower surface 20*b*.

FIGS. 1-6 show three example operating conditions of barrier 10. FIGS. 1 and 2 show tubes 22 in an inflated state and an at rest shape (i.e., a normal shape the barrier assumes when nothing is passing through it). The pressure in tubes 22 creates a pneumatic seal 50 extending longitudinally at the interface between tubes 22*a* and 22*b*. The term, "pneumatic seal" means the seal is at least partially actuated by gas pressure.

Figure 3:
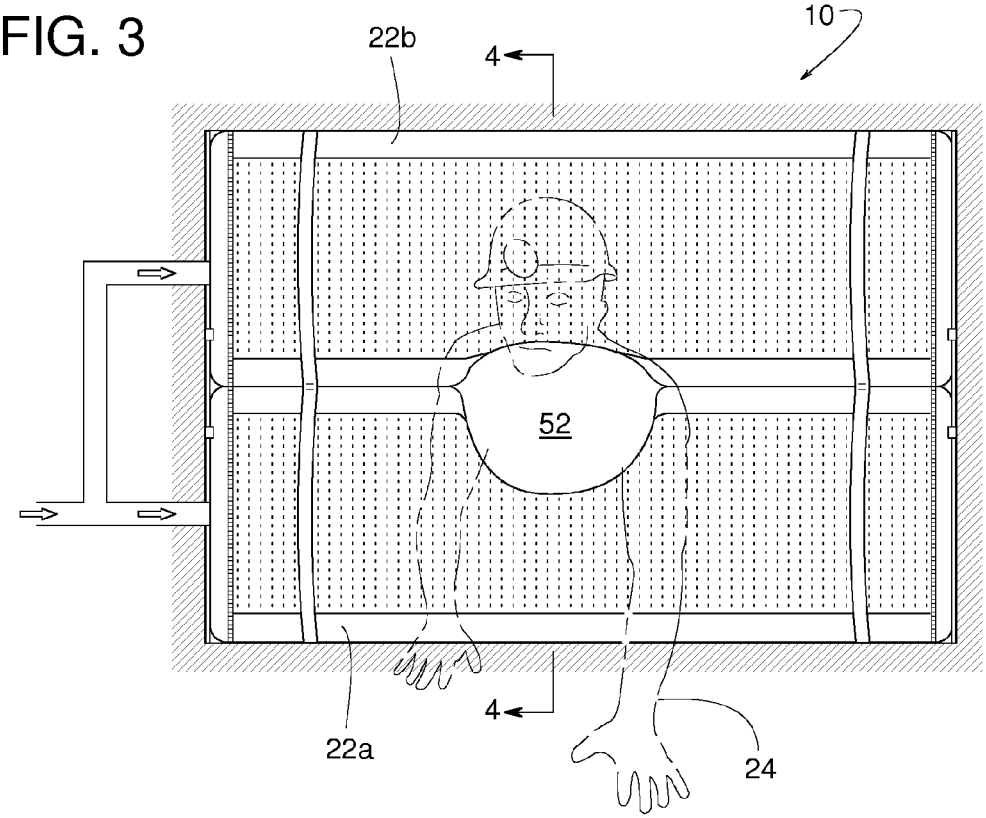
FIG. 3 is a side view of the example air barrier of FIG. 1 but showing an individual crawling through the example barrier.
Figure 4:
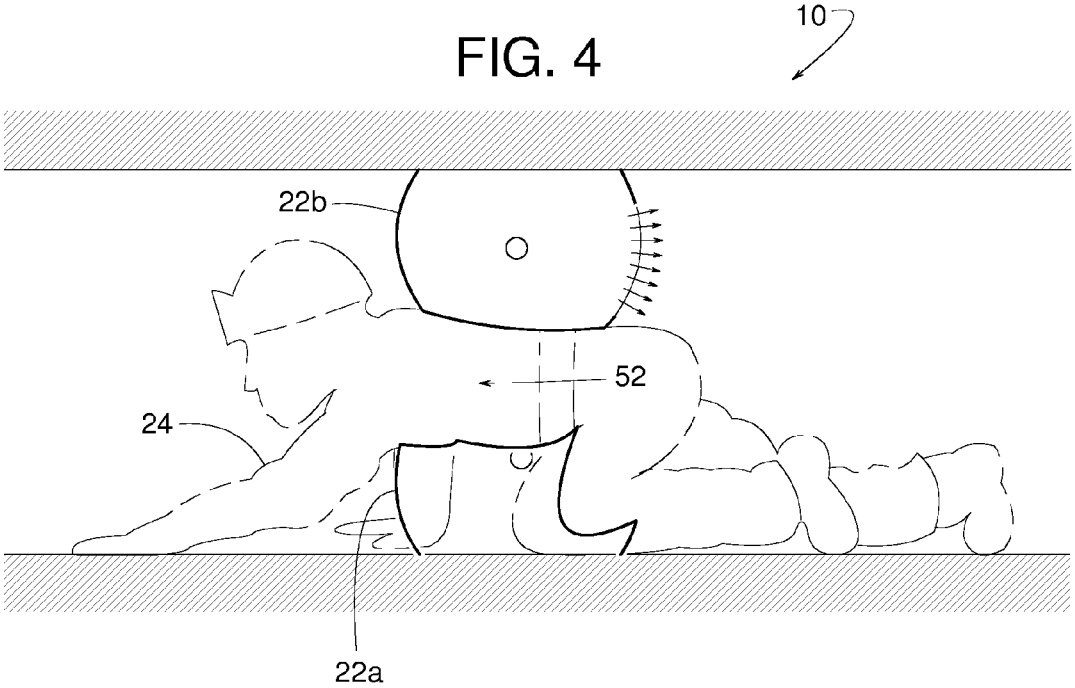
FIG. 4 is a cross-sectional view of the example air barrier of FIG. 3.

When individual 24 crawls through barrier 10 while tubes 22 are inflated, as shown in FIGS. 3 and 4, individual 24 distorts tubes 22 from their normal shape (FIGS. 1 and 2) to a manually deformed shape (FIGS. 3 and 4). The tube distortion opens pneumatic seal 50 to create an access opening 52 through which individual 24 crawls. Pressure within tubes 22 presses sidewall 26 conformingly against individual 24 to minimize contaminated gas leakage between sidewall 26 and individual 24.

To further minimize contaminated gas from leaking into the less contaminated area 18, some examples of tube 22 include an air permeable sidewall section 54 facing the more contaminated area 16. Clean pressurized air 36 within tube 22 bleeds through a plurality of small holes 56 in section 54. Holes 56 are broadly distributed in two dimensions (e.g., vertically and horizontally) to create a gentle movement of air 58 that pushes contaminated air away from the entrance of barrier 10.

It has been discovered that holes 56 should be sufficiently small, uniform, and densely distributed because larger and fewer holes create discrete streams of higher velocity air that tend to draw in lower velocity surrounding air. In some examples, the lower velocity surrounding air comes from the more contaminated area 16. It is believed that due to the Bernoulli principle, higher velocity streams of air generate local regions of subatmospheric pressure that draws in contaminated gas at atmospheric pressure.

Figure 7:
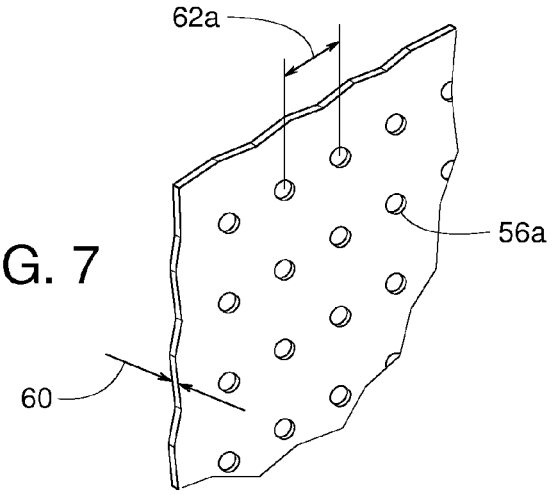
FIG. 7 is a perspective close-up view of an example air permeable sidewall material constructed according to the teachings disclosed herein.
Figure 8:
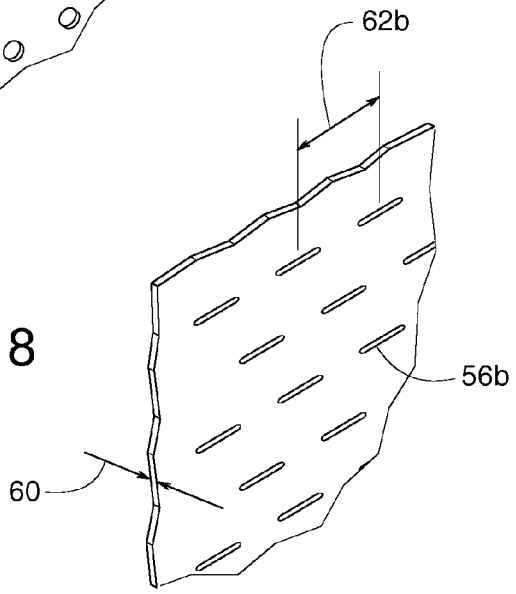
FIG. 8 is a perspective close-up view of another example air permeable sidewall material constructed according to the teachings disclosed herein.
Figure 9:
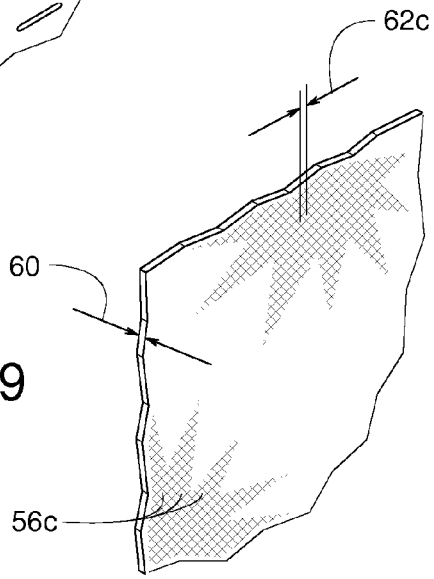
FIG. 9 is a perspective close-up view of yet another example air permeable sidewall material constructed according to the teachings disclosed herein.

To create a blanket of slow moving clean air 58 adjacent barrier 10, some examples of sidewall section 54 have holes 56 with an average hole size that is less than ten times the average material wall thickness 60 of the tube's sidewall (see FIGS. 7-9). The term, "hole size" is defined herein as the diameter of a circle having the same area as the open area of the hole. Holes 56 (e.g., holes 56*a*, 56*b* and 56*c*) can be any shape, examples of which include, but are not limited to, round (FIG. 7), slits (FIG. 8), fabric pores (FIG. 9). In some examples, for broad distribution, holes 56 are spaced apart with an average spaced-apart distance (e.g., distance 62*a*, 62*b* or 62*c*) that is less than fifty times the average material wall thickness 60 of the tube's sidewall. The spaced-apart distance is with respect to the center of one hole to the center of an adjacent hole. In some examples, holes 56 have a distribution of at least 10 holes per square-centimeter.

Figure 5:
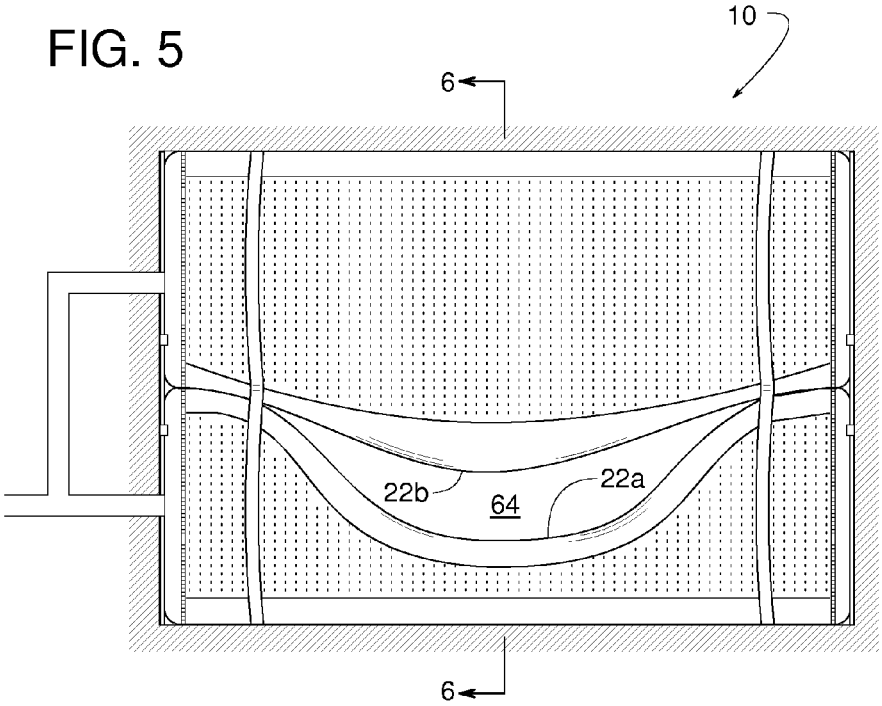
FIG. 5 is a side view similar to FIG. 1 but showing the example barrier in a deflated state.
Figure 6:
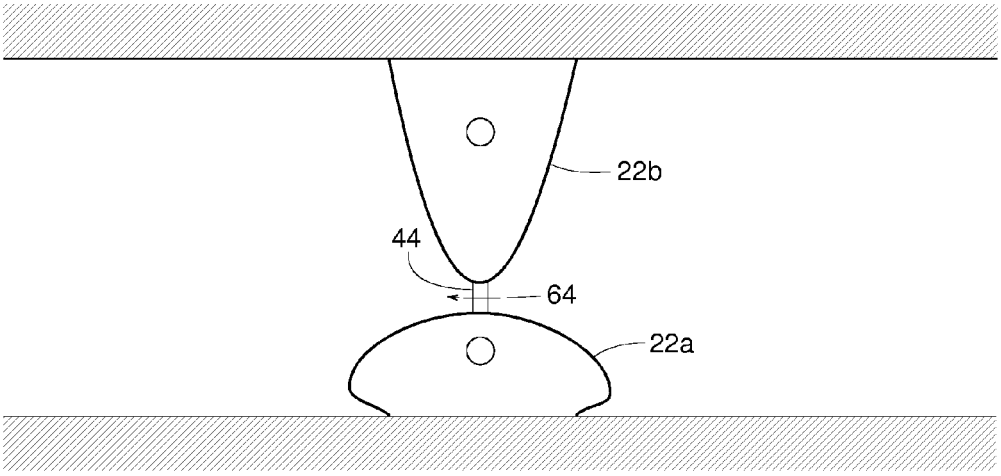
FIG. 6 is a cross-sectional view of the example air barrier of FIG. 5.

When barrier 10 is not in active use, tubes 22 are left in an unpressurized deflated state, as shown in FIGS. 5 and 6. In some examples, tubes 22 in the deflated state are relatively limp with an opening 64 between tubes 22*a* and 22*b*.

Figure 12:
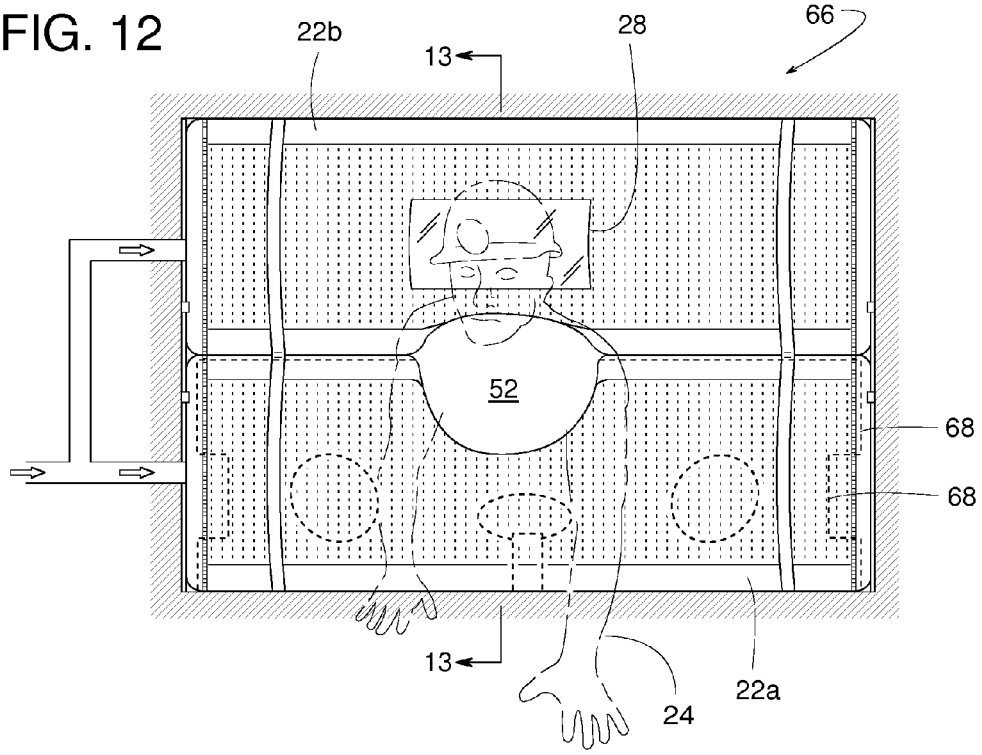
FIG. 12 is a side view similar to FIG. 10 but showing an individual crawling through the example barrier.
Figure 13:
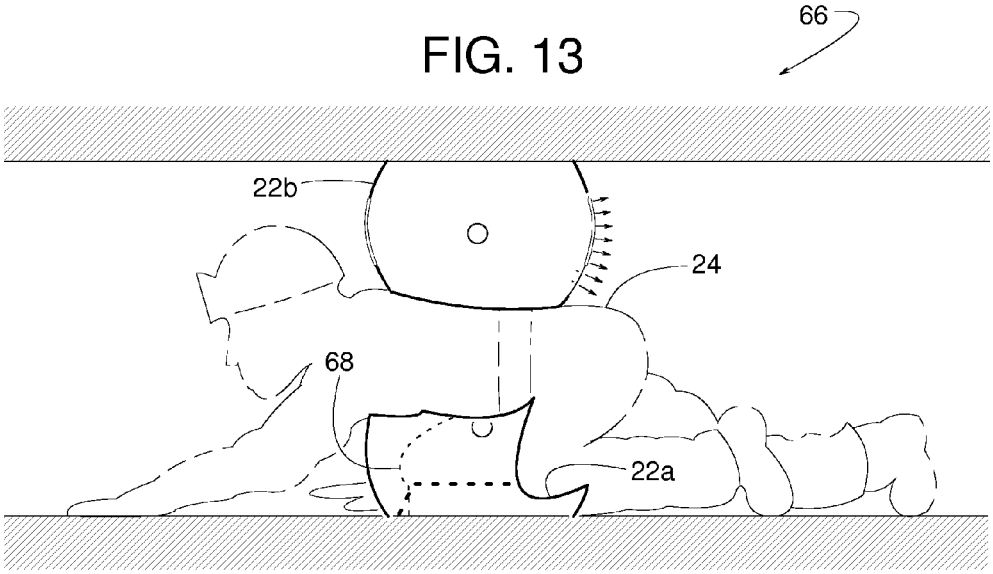
FIG. 13 is a cross-sectional view of the example air barrier of FIG. 12.
Figure 14:
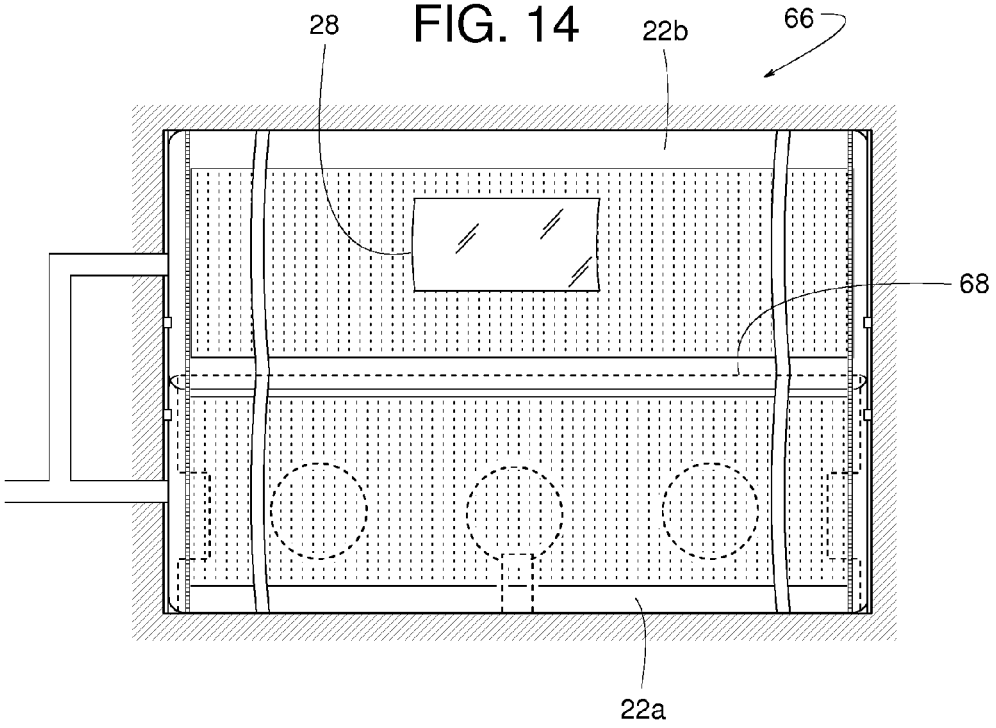
FIG. 14 is a side view similar to FIG. 10 but showing the barrier in a deflated state.
Figure 15:
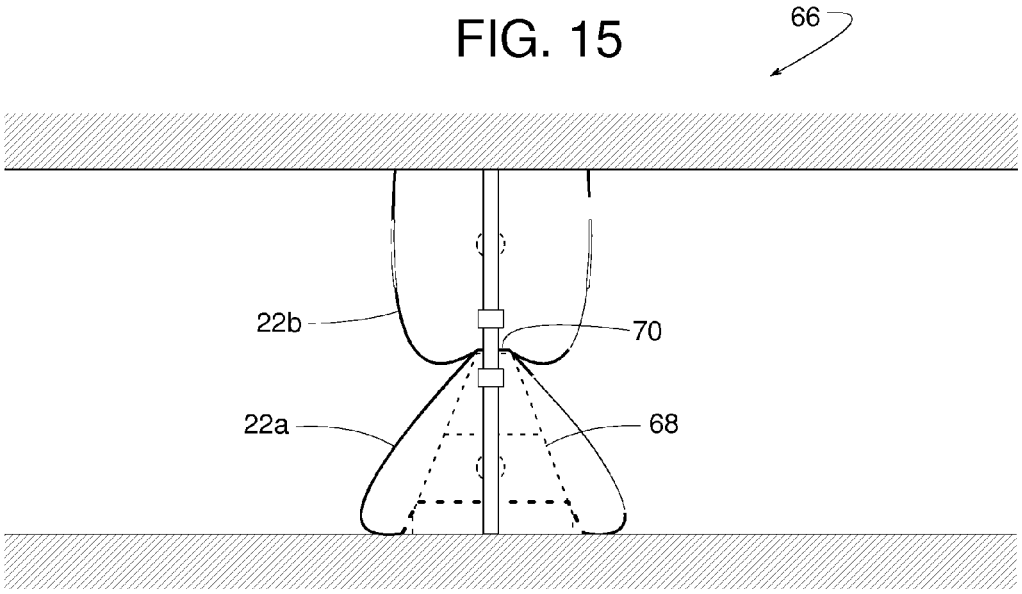
FIG. 15 is an end view of the example air barrier of FIG. 14.
Figure 16:
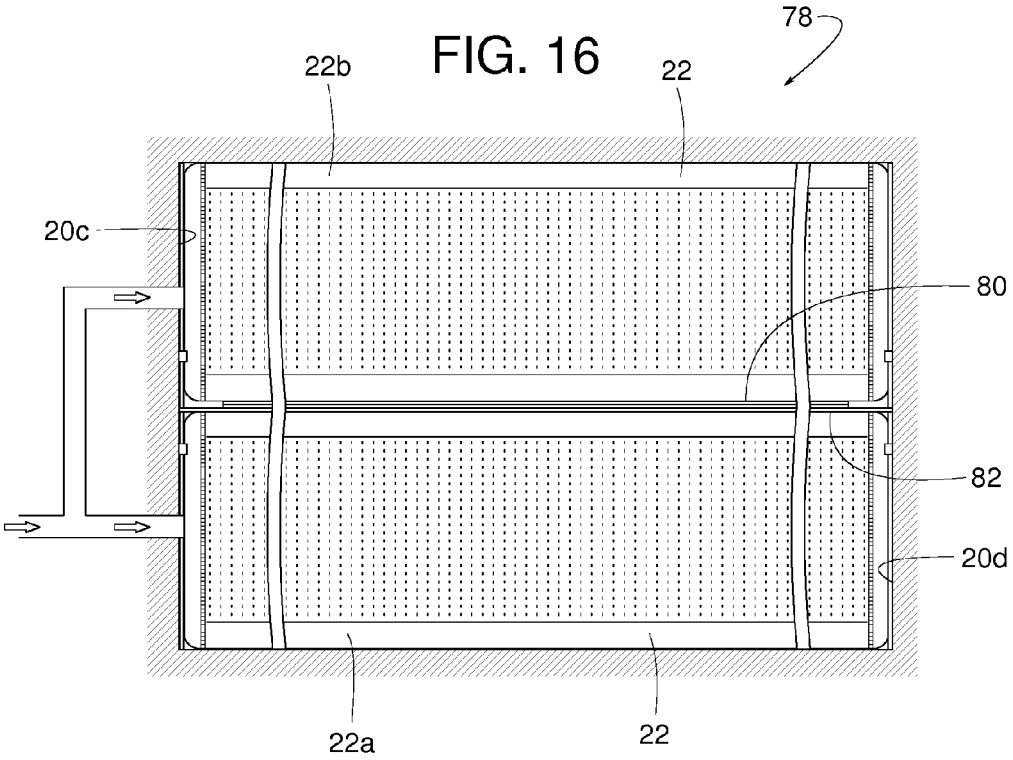
FIG. 16 is a side view of another example inflatable air barrier constructed according to the teachings disclosed herein, wherein the barrier is in a closed, inflated state.
Figure 17:
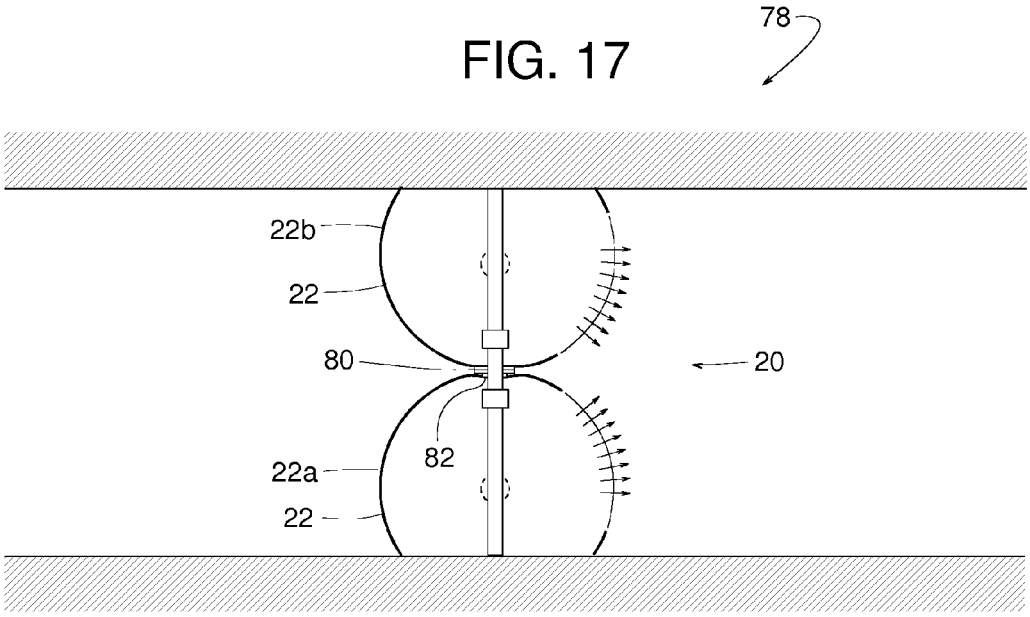
FIG. 17 is an end view of the example air barrier of FIG. 16.
Figure 18:
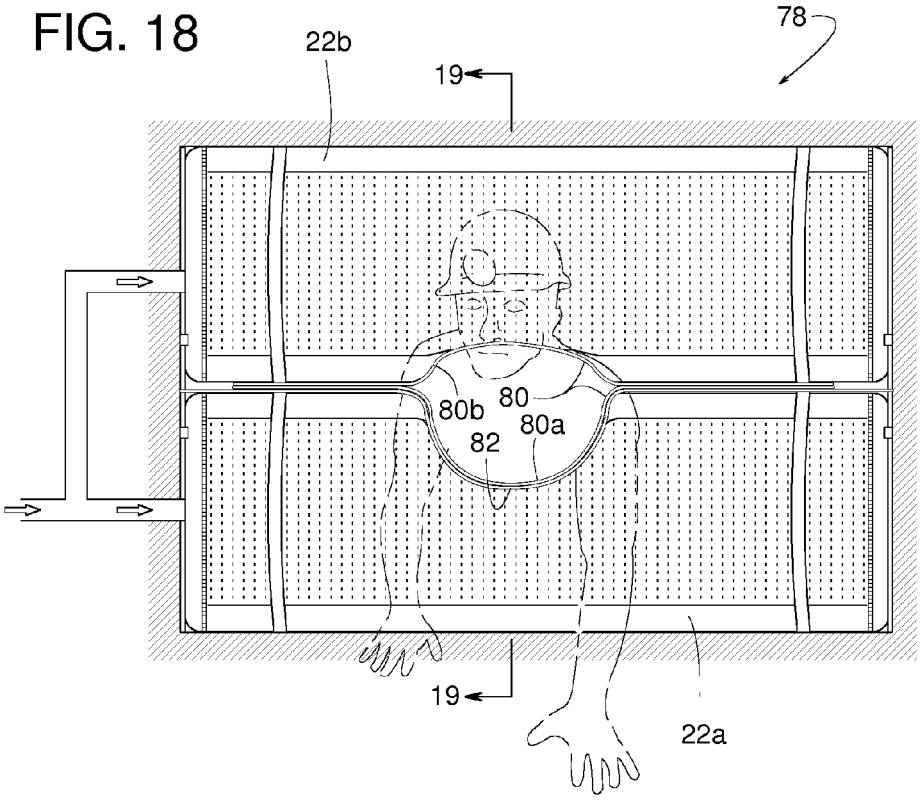
FIG. 18 is a side view similar to FIG. 16 but showing an individual crawling through the barrier.
Figure 19:
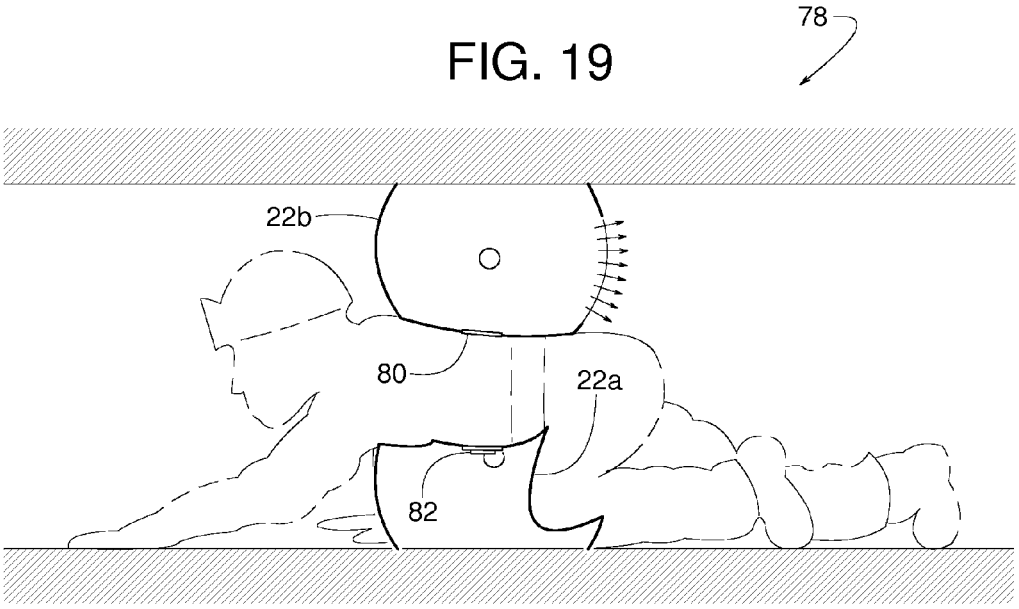
FIG. 19 is a cross-sectional view of the example air barrier of FIG. 18.

In the example of FIGS. 10-15, however, opening 64 is eliminated even when tubes 22 are in the deflated state, as shown in FIGS. 14 and 15. Eliminating opening 64 helps keep area 18 relatively clean before inflating tubes 22. To achieve such results, an example inflatable barrier 66 includes a resiliently compressible foam body 68 installed within tube 22*a*. In some examples, the foam body 68 has a substantially triangular cross-section to enable an end of the foam body 68 adjacent the pneumatic seal 50 to be relatively flexible. In addition to eliminating opening 64, foam body 68 displaces a significant amount of air volume within tube 22, so less pressurized air 36 is required to inflate tube 22. This benefit is particularly important in a compromised mine where air is a very precious commodity. Also, with tube 22 requiring less air to fully inflate, tube 22 can be inflated in less time, which is usually important during emergencies. Foam body 68 is one example of a resilient member engaging first tube 22*a* and being manually movable to a manually deflected state (FIGS. 12 and 13) and a restored state (FIGS. 10, 11, 14 and 15).

Figure 10:
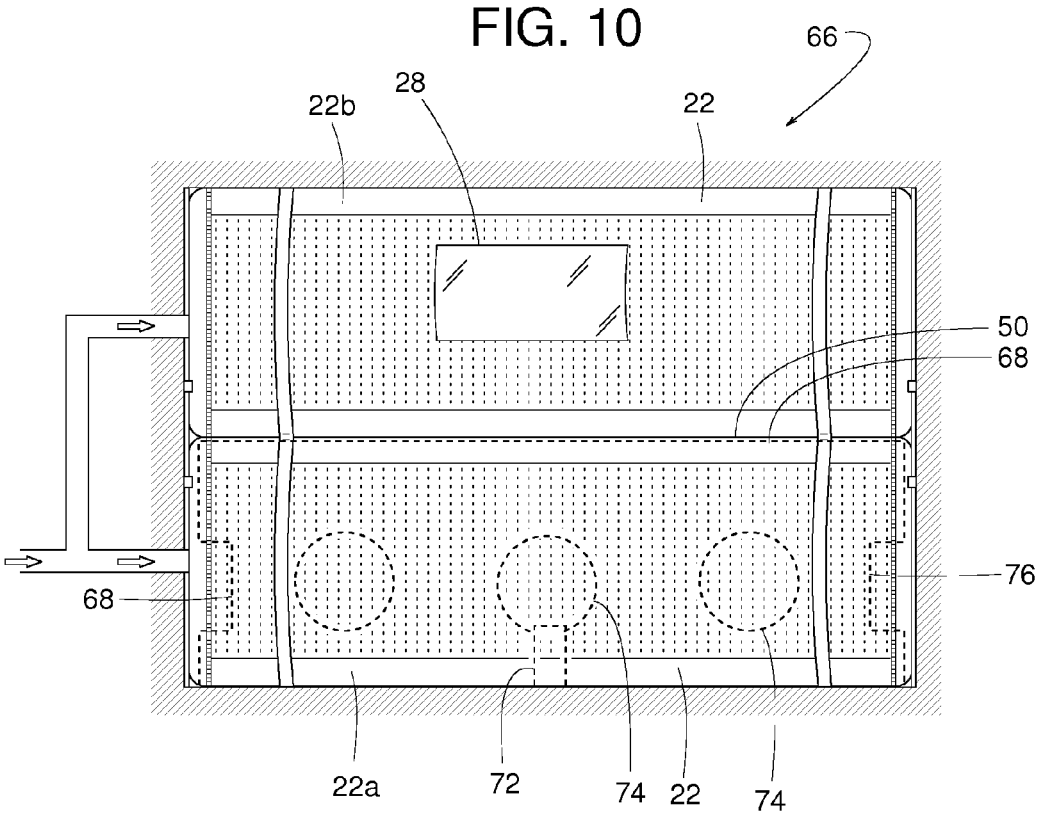
FIG. 10 is a side view of another example inflatable air barrier constructed according to the teachings disclosed herein, wherein the barrier is in a closed, inflated state.
Figure 11:
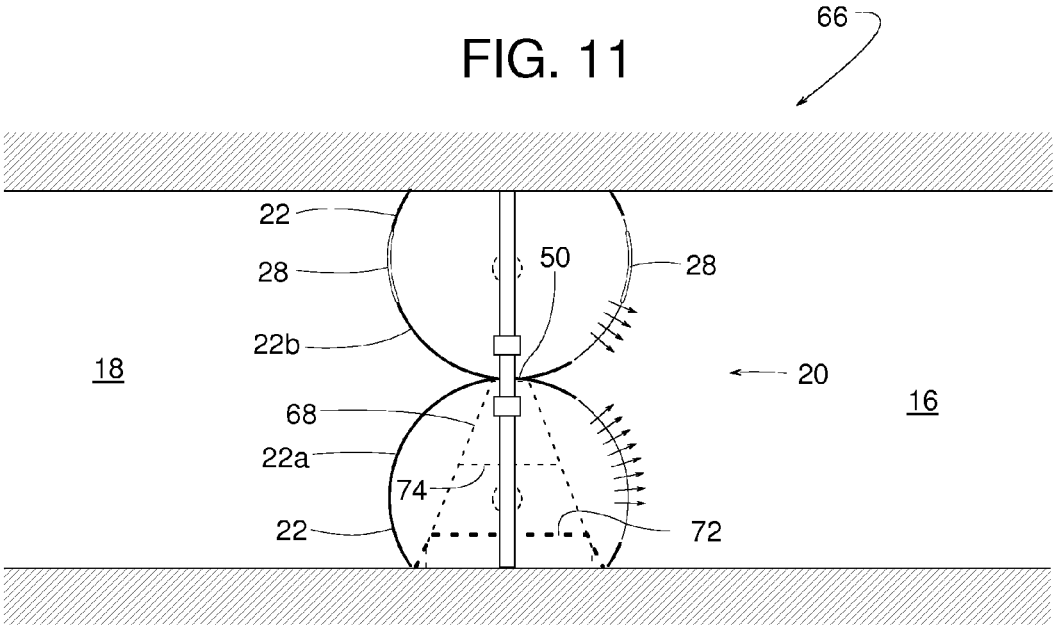
FIG. 11 is an end view of the example air barrier of FIG. 10.

When tubes 22 are deflated, foam body 68 holds tube 22*a* up against tube 22*b* to establish a mechanical seal 70 between tubes 22*a* and 22*b*. The term, "mechanical seal" refers to a seal that can be held substantially closed without having to rely on pneumatic pressure. In some examples, pneumatic seal 50 and mechanical seal 70 close at the same interface between tubes 22*a* and 22*b*. In such examples, pneumatic seal 50 and mechanical seal 70 open and close as one sealing unit. When tubes 22 are in their inflated state and/or normal shape, as shown in FIGS. 10 and 11, both pneumatic seal 50 and mechanical seal 70 are closed.

When individual 24 crawls through barrier 66 while tubes 22 are inflated, as shown in FIGS. 12 and 13, individual 24 readily compresses foam body 68 from its restored state (FIGS. 10 and 11) to its deflected state (FIGS. 12 and 13) and distorts tubes 22 from their normal shape and/or inflated state (FIGS. 10 and 11) to a manually deformed shape (FIGS. 12 and 13). The compression of foam body 68 and the distortion of tubes 22 open both mechanical seal 70 and pneumatic seal 50 to create access opening 52 through which individual 24 crawls. After individual 24 has passed through barrier 66, as shown in FIGS. 14 and 15, foam body 68 resiliently returns to its restored state to close mechanical seal 70 even if tubes 22 are deflated.

In some examples, foam body 68 has a strap anchor 72 and cavities 74 and 76. Strap anchor 72 helps hold foam body 68 in the proper position within tube 22*a*. Cavities 74 and 76 are holes and/or notches that reduce the force need to compress foam body 68 and allow for inflation of tube 22 without additional resistance to airflow.

In some examples, to enhance sealing between tubes 22*a* and 22*b*, an example inflatable barrier 78 includes a magnet 80 (e.g., a magnetic strip) and/or an elastic strap 82 extending lengthwise along the sealing interface between tubes 22*a* and 22*b*. Magnet 80 is schematically illustrated to represent any two strips or pieces that are magnetically attracted to each other, wherein one piece 80*a* is sewn or otherwise attached to tube 22*a*, and another piece 80*b* is sewn or otherwise attached to tube 22*b*.

Figure 20:
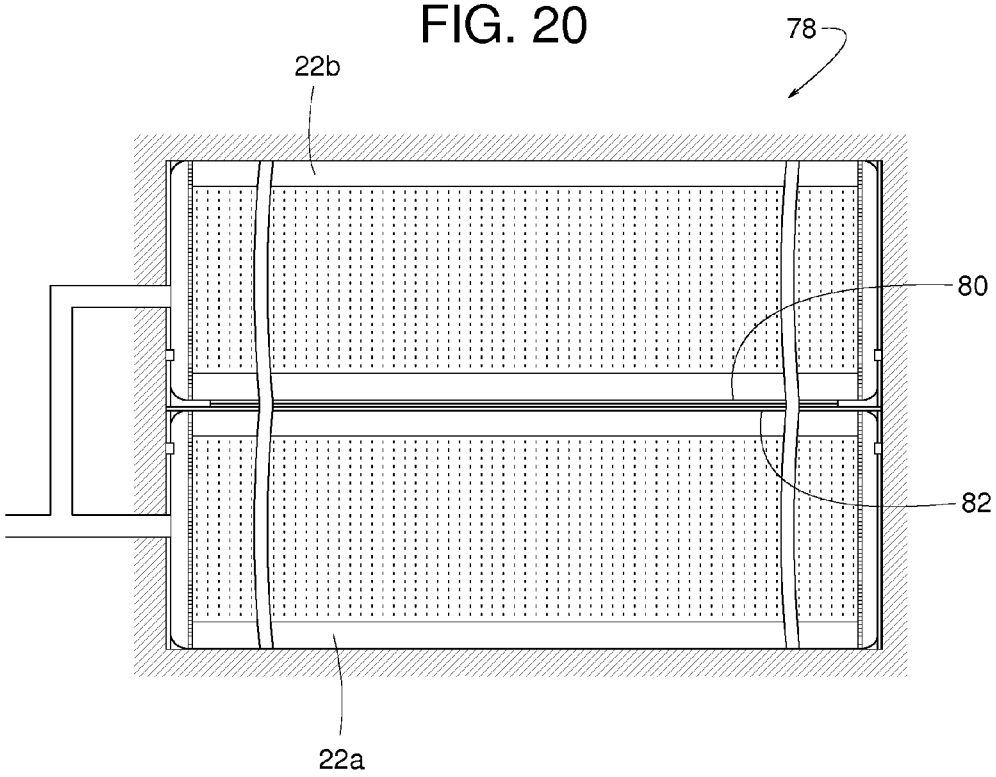
FIG. 20 is a side view similar to FIG. 16 but showing the example barrier in a deflated state.
Figure 21:
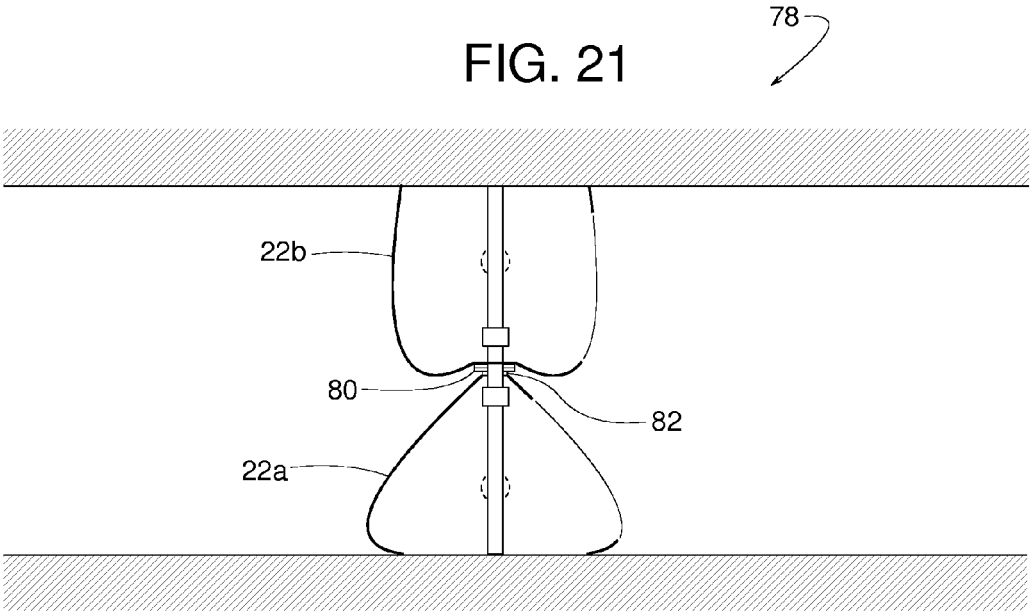
FIG. 21 is an end view of the example air barrier of FIG. 20.

Except for the addition of magnet 80 and strap 82, barriers 78 and 10 are identical in structure and function with FIGS. 16-21 corresponding to FIGS. 1-6, respectively. Barrier 78 with magnet 80 (with or without strap 82) provides a tight seal between tubes 22*a* and 22*b* even when they are deflated, as shown in FIGS. 20-21. If contact between the tubes 22*a* and 22*b* is broken, the tubes 22*a* and 22*b* will need to be re-inflated to re-seal the interface.

Elastic strap 82 is an example of a resilient member engaging the interior or exterior of tube 22*a* and being manually movable to a manually deflected state (FIGS. 18 and 19) and a restored state (FIGS. 16, 17, 20 and 21). An elastic cord is another example of such a resilient member. In some examples, opposite ends of elastic strap 82 are attached to lateral surfaces 20*c* and 20*d* and the medial section of strap 82 is sewn or otherwise attached to tube 22*a*. This gives tube 22*a* some support when tube 22*a* is deflated, thus strap 82 provides a function similar to that of foam body 68. Strap 82 can be used with or without magnet 80.

Figure 22:
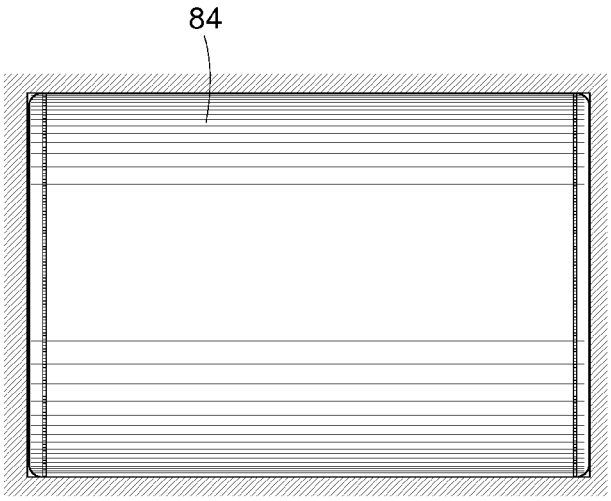
FIG. 22 is a side view of another example inflatable air barrier constructed according to the teachings disclosed herein, wherein the barrier is in a closed, inflated state.
Figure 23:
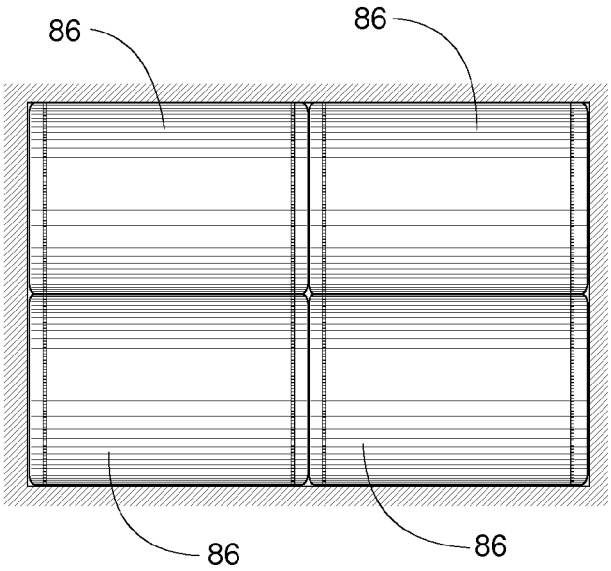
FIG. 23 is a side view of another example inflatable air barrier constructed according to the teachings disclosed herein, wherein the barrier is in a closed, inflated state.
Figure 24:
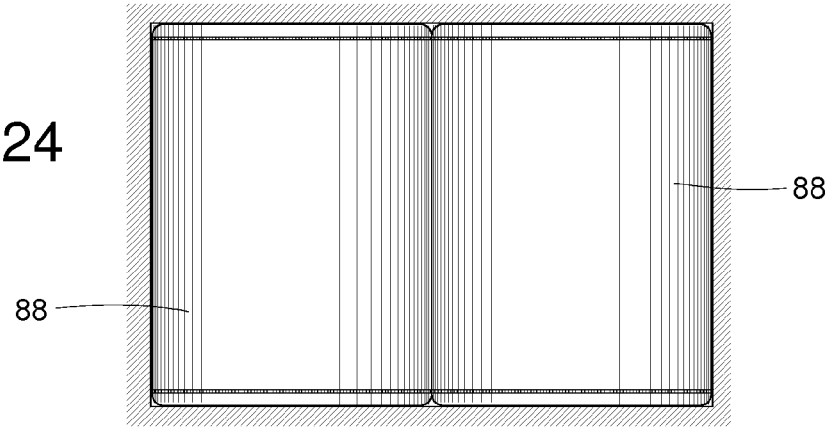
FIG. 24 is a side view of another example inflatable air barrier constructed according to the teachings disclosed herein, wherein the barrier is in a closed, inflated state.

Although various examples of inflatable air barriers are illustrated as comprising two generally horizontal inflatable tubes, other example barriers have any number of tubes in other orientations. For instance, FIG. 22 shows a single horizontal tube 84, FIG. 23 shows four horizontal tubes 86 that meet generally at the center of passageway 20, and FIG. 24 shows two vertical tubes 88. One or more features used in some example barriers disclosed herein can be directly used or readily adapted for use in other example barriers.

As set forth herein, an example inflatable air barrier for a passageway extending between a first area and a second area, the passageway being defined by an upper surface, a lower surface, a first lateral surface and a second lateral surface. The inflatable air barrier includes a first tube having an inflated state and a deflated state. The first tube is manually deformable in the inflated state from a normal shape to a manually deformed shape. The first tube is to provide a pneumatic seal within the passageway when the first tube is in the inflated state while in the normal shape. The pneumatic seal is to provide an access opening through the passageway when the first tube is in the inflated state while in the manually deformed shape. The first tube in the deflated state is substantially unpressurized. The first tube includes a first sidewall section to face the first area. The first sidewall section includes an air permeable material having a plurality of holes distributed in two dimensions across a surface of the first sidewall section.

In some examples, the first tube includes a second sidewall section to face the second area. In some examples, the second sidewall section is substantially impermeable to air. In some examples, the first sidewall section includes at least twenty percent of the first tube. In some examples, the inflatable air barrier also includes a second tube substantially similar to the first tube. The pneumatic seal is to be defined between the first tube and the second tube, and the access opening, when present, is between the first tube and the second tube. In some examples, the permeable material has a material wall thickness and the plurality of holes are spaced apart with an average spaced apart distance of less than fifty times the material wall thickness. In some examples, the inflatable air barrier also includes a magnet to form the pneumatic seal. In some examples, the first tube includes a curved surface facing upward and a substantially flat surface facing downward. In some examples, the air permeable material has a material wall thickness, and an average hole size of the plurality of holes divided by the material wall thickness is less than ten to broadly disperse air out from within the first tube into the designated more contaminated area.

Another example inflatable air barrier for a passageway extending between a first area and a second area, the passageway being defined by an upper surface, a lower surface, a first lateral surface and a second lateral surface. The inflatable air barrier includes a pneumatic seal within the passageway. The pneumatic seal is selectively opened and closed. A mechanical seal is within the passageway. The mechanical seal is selectively opened and closed. A first tube has an inflated state and a deflated state. The first tube in the inflated state is manually deformable from a rest shape to a manually deformed shape. The first tube provides and closes the pneumatic seal within the passageway when the first tube is in the inflated state while in the rest shape. The first tube opens the pneumatic seal and provides an access opening through the passageway when the first tube is in the inflated state while in the manually deformed shape. The first tube is substantially unpressurized in the deflated state. A resilient member engages the first tube. The resilient member is manually movable between a restored state and a deflected state. The resilient member in the restored state supports the first tube to provide and close the mechanical seal within the passageway. The resilient member in the deflected state yields with the first tube to open the mechanical seal within the passageway.

In some examples, the pneumatic seal and the mechanical seal are to open and close as one sealing unit. In some examples, the resilient member includes a resiliently compressible foam body disposed within the first tube. In some examples, the inflatable air barrier also includes an anchor fastening the resiliently compressible foam body to the first tube. In some examples, the resiliently compressible foam body defines a cavity. In some examples, the resiliently compressible foam body is elongate in a longitudinal direction and has a generally triangular cross-section perpendicular to the longitudinal direction. In some examples, the resilient member includes a resiliently flexible elongate member connected to the first tube. In some examples, the inflatable air barrier also includes a second tube substantially similar to the first tube. The pneumatic seal is between the first tube and the second tube, and the access opening, when present, is between the first tube and the second tube. A resiliently flexible elongate member connects the first tube to the second tube. In some examples, the resiliently flexible elongate member lies between the first tube and at least one of the first area and the second area. In some examples, the resiliently flexible elongate member lies between an axial end of the first tube and at least one of the surfaces of the passageway. In some examples, the inflatable air barrier also includes a second tube substantially similar to the first tube. The pneumatic seal is between the first tube and the second tube, and the access opening, when present, is between the first tube and the second tube. A resiliently flexible elongate member is connected to the first tube and lying proximate and substantially parallel to the pneumatic seal. In some examples, at least one of the mechanical seal or the pneumatic seal includes a magnet. In some examples, the first tube includes a curved surface and a substantially flat surface. The flat surface is to be adjacent one of the surfaces of the passageway.

Another example inflatable air barrier for a passageway extending between a designated more contaminated area and a designated less contaminated area, the passageway being defined by an upper surface, a lower surface, a first lateral surface and a second lateral surface. The inflatable air barrier includes a first body and a second body defining a pneumatic seal within the passageway. The pneumatic seal is selectively opened and closed. Each of the first body and the second body have an inflated state and a deflated state. The first body is manually deformable when in the inflated state from a first shape to a manually deformed shape. The first body cooperates with the second body to close the pneumatic seal within the passageway when the first body is in the inflated state while in the first shape. The first body opening the pneumatic seal between the first body and the second body when the first body is in the inflated state while in the manually deformed shape. The first body is substantially unpressurized in the deflated state. A resiliently flexible elongate member is attached to the first body.

In some examples, the second body is substantially similar to the first body. The resiliently flexible elongate member is attached to both the first body and the second body. In some examples, the resiliently flexible elongate member lies between the first body and at least one of the first area or the second area. In some examples, the resiliently flexible elongate member lies between an axial end of the first body and at least one of the surfaces of the passageway. In some examples, the resiliently flexible elongate member lies proximate and substantially parallel to the pneumatic seal. In some examples, inflatable air barrier also includes a magnet to urge the pneumatic seal to a closed position.

Another example inflatable air barrier for a passageway extending between first area and a second area. The inflatable air barrier includes a pneumatic seal within the passageway. The pneumatic seal is selectively opened and closed. A body includes a tubular sidewall interposed between a first end cap and a second end cap. The body has an inflated state and a deflated state. The body in the inflated state is manually deformable from a normal shape to a manually deformed shape. The body defines the pneumatic seal within the passageway between the first area and the second area. The body is to enable opening the pneumatic seal to provide an access opening when the body is in the inflated state while in the manually deformed. The tube is substantially unpressurized in the deflated state. At least one of the first end cap or the second end cap being removable and reattachable to the tubular sidewall.

In some examples, at least one of the first end cap or the second end cap defines an air inlet, and the first end cap and the second end cap are interchangeable. In some examples, the inflatable air barrier also includes a releasable fastener connecting at least one of the first end cap or the second end cap to the tubular sidewall. In some examples, the releasable fastener includes a zipper. In some examples, at least one of the first end cap or the second end cap are to seal under pneumatic pressure against at least one of the surfaces of the passageway. In some examples, the inflatable air barrier also includes a resiliently flexible elongate member connecting at least one of the first end cap or the second end cap to at least one of the upper surface, the lower surface, the first lateral surface or the second lateral surface. In some examples, the pneumatic seal includes a magnet.

Another example inflatable air barrier for a passageway extending between a designated more contaminated area and a designated less contaminated area, the passageway being defined by an upper surface, a lower surface, a first lateral surface and a second lateral surface. The inflatable air barrier includes a pneumatic seal within the passageway. The pneumatic seal is selectively opened and closed. A tube has an inflated state and a deflated state. The tube in the inflated state is manually deformable from a normal shape to a manually deformed shape. The tube provides and closes the pneumatic seal within the passageway when the tube is in the inflated state while in the normal shape. The tube opens the pneumatic seal to provide an access opening when the tube is in the inflated state while in the manually deformed shape. The tube is substantially unpressurized in the deflated state. A transparent section is on the tube.

Another example inflatable air barrier for a passageway extending between a designated more contaminated area and a designated less contaminated area, the passageway being defined by an upper surface, a lower surface, a first lateral surface and a second lateral surface. The inflatable air barrier includes a pneumatic seal within the passageway. The pneumatic seal is selectively opened and closed. A tube has an inflated state and a deflated state. The tube in the inflated state is manually deformable from a normal shape to a manually deformed shape. The tube provides and closes the pneumatic seal within the passageway when the tube is in the inflated state while in the normal shape. The tube opens the pneumatic seal and provides an access opening when the tube is in the inflated state while in the manually deformed shape. The tube substantially is unpressurized in the deflated state and a magnet at the pneumatic seal.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. An inflatable air barrier for a passageway extending between a first area and a second area, the passageway being defined by an upper surface, a lower surface, a first lateral surface and a second lateral surface, the inflatable air barrier comprising:

an inflatable tube having an inflated state and a deflated state, the inflatable tube being manually deformable in the inflated state from a normal shape to a manually deformed shape, the inflatable tube to extend across the passageway with ends to be urged against the first lateral surface and the second lateral surface of the passageway to provide a pneumatic seal within the passageway between the inflatable tube and the first and second lateral surfaces of the passageway when the inflatable tube is in the inflated state while in the normal shape, an access opening through the passageway to be provided when the inflatable tube is in the inflated state while in the manually deformed shape.

2. The inflatable air barrier of claim 1, wherein the inflatable tube includes a first sidewall section to face the first area and a second sidewall section to face the second area, the first sidewall section including an air permeable material having a plurality of holes distributed in two dimensions across a surface of the first sidewall section, the second sidewall section being substantially impermeable to air.

3. The inflatable air barrier of claim 2, wherein the first sidewall section includes at least twenty percent of the inflatable tube.

4. The inflatable air barrier of claim 1, wherein the inflatable tube includes a first inflatable tube and the pneumatic seal includes a first pneumatic seal, further including a second inflatable tube substantially similar to the first inflatable tube, the first and second inflatable tubes to be urged against one another to provide a second pneumatic seal between the first inflatable tube and the second inflatable tube when the first and second inflatable tubes are in the inflated state while in the normal shape, the access opening, when present, between the first tube and the second tube.

5. The inflatable air barrier of claim 2, wherein the permeable material has a material wall thickness and the plurality of holes are spaced apart with an average spaced apart distance of less than fifty times the material wall thickness.

6. The inflatable air barrier of claim 1, further including a magnet to form a pneumatic seal between the inflatable tube and a second inflatable tube.

7. The inflatable air barrier of claim 1, wherein the inflatable tube includes a curved surface facing upward and a substantially flat surface facing downward, the substantially flat surface to be urged against the passageway.

8. The inflatable air barrier of claim 2, wherein the air permeable material has a material wall thickness, and an average hole size of the plurality of holes divided by the material wall thickness is less than ten to broadly disperse air out from within the inflatable tube into the first area.

9. An inflatable air barrier for a passageway extending between a first area and a second area, the passageway being defined by an upper surface, a lower surface, a first lateral surface and a second lateral surface, the inflatable air barrier comprising:

a first inflatable body;

a second inflatable body, the first and second inflatable bodies to be separate from and removably coupled to the passageway, the first and second inflatable bodies to be urged against the passageway and one another to define a pneumatic seal within the passageway, the pneumatic seal being selectively opened and closed, the first inflatable body being manually deformable when in an inflated state from a first shape to a manually deformed shape, the first inflatable body cooperating with the second inflatable body to close the pneumatic seal within the passageway when the first inflatable body is in the inflated state while in the first shape, the first inflatable body opening the pneumatic seal between the first inflatable body and the second inflatable body when the first inflatable body is in the inflated state while in the manually deformed shape; and a resiliently flexible elongate member attached to the first inflatable body and the second inflatable body to hold the first and second inflatable bodies together.

10. The inflatable air barrier of claim 9, wherein the second inflatable body is substantially similar to the first inflatable body.

11. The inflatable air barrier of claim 9, wherein the resiliently flexible elongate member is disposed between the first inflatable body and at least one of the first area or the second area.

12. The inflatable air barrier of claim 10, wherein the resiliently flexible elongate member is disposed between an axial end of the first inflatable body and at least one of the surfaces of the passageway.

13. The inflatable air barrier of claim 9, wherein the resiliently flexible elongate member lies proximate and substantially parallel to the pneumatic seal.

14. The inflatable air barrier of claim 9, further including a magnet to urge the pneumatic seal to a closed position.

15. An inflatable air barrier for a passageway extending between a first area and a second area, the inflatable air barrier comprising:

a tubular body including a tubular sidewall extending between a first end cap and a second end cap, the first and second end caps to enclose an interior of the tubular body, the tubular body having an inflated state and a deflated state, the tubular body in the inflated state being manually deformable from a normal shape to a manually deformed shape, the tubular body to be urged against the passageway to define a pneumatic seal within the passageway between the first area and the second area, the passageway being relatively more rigid than the tubular body, the pneumatic seal being selectively opened and closed, the tubular body to enable opening the pneumatic seal to provide an access opening when the tubular body is in the inflated state while in the manually deformed shape.

16. The inflatable air barrier of claim 15, wherein at least one of the first end cap or the second end cap defines an air inlet, and the first end cap and the second end cap are interchangeable.

17. The inflatable air barrier of claim 15, further including a releasable fastener connecting at least one of the first end cap or the second end cap to the tubular sidewall.

18. The inflatable air barrier of claim 17, wherein the releasable fastener includes a zipper.

19. The inflatable air barrier of claim 15, wherein at least one of the first end cap or the second end cap are to seal under pneumatic pressure against a surface of the passageway.

20. The inflatable air barrier of claim 15, further including a resiliently flexible elongate member removably connecting at least one of the first end cap or the second end cap to at least one of a upper surface, a lower surface, a first lateral surface, or a second lateral surface of the passageway.

21. The inflatable air barrier of claim 15, wherein at least a portion of the pneumatic seal includes a magnet.

22. An inflatable air barrier for a passageway extending between a first area and a second area, the passageway being defined by an upper surface, a lower surface, a first lateral surface and a second lateral surface, the inflatable air barrier comprising:

a tube having an inflated state and a deflated state, the tube in the inflated state being manually deformable from a normal shape to a manually deformed shape, the tube to be urged against the passageway to provide a pneumatic seal against at least one of the upper surface, the lower surface, the first lateral surface, or the second lateral surface of the passageway when the tube is in the inflated state while in the normal shape, an access opening to be defined by the tube when the tube is in the inflated state while in the manually deformed shape, the tube being constructed independent of and separate from the passageway using a different material than the passageway; and a strap to secure the tube to at least one of the upper surface, the lower surface, the first lateral surface, or the second lateral surface of the passageway.

23. The inflatable air barrier of claim 22, further including a magnet at to form a pneumatic seal between the tube and a second tube when the tube is in the inflated state.

24. The inflatable air barrier of claim 9, wherein the first and second inflatable bodies are to extend across the passageway between the first and second lateral surfaces with the first inflatable body below the second inflatable body.

25. The inflatable air barrier of claim 24, wherein the resiliently flexible elongate member stabilizes the first and second inflatable bodies relative to each other.

26. The inflatable air barrier of claim 9, wherein the resiliently flexible elongate member holds at least part of the first inflatable body adjacent the second inflatable body when the first inflatable body is in the inflated state while in the manually deformed shape.

27. The inflatable air barrier of claim 9, wherein the resiliently flexible elongate member holds at least part of the first inflatable body adjacent the second inflatable body when the first inflatable body is in a deflated state.

28. The inflatable air barrier of claim 15, wherein the first and second end caps are to be removably coupled to respective first and second lateral surfaces of the passageway.

* * * * *